United States Patent [19]

Bessho et al.

[11] Patent Number: 4,528,963

[45] Date of Patent: Jul. 16, 1985

[54] METHOD OF AND SYSTEM FOR CONTROLLING RESTART OF ENGINE

[75] Inventors: Hironori Bessho, Susono; Yuuichi Takano, Nagoya; Katsuhiko Aoyama, Toyota, all of Japan

[73] Assignee: Toyota Jidosha Kabushiki Kaisha, Toyota, Japan

[21] Appl. No.: 554,709

[22] Filed: Nov. 23, 1983

[30] Foreign Application Priority Data

May 9, 1983 [JP] Japan ..... 58-80631

[51] Int. Cl.[3] ..... F02N 17/08

[52] U.S. Cl. ..... 123/491; 123/179 L

[58] Field of Search ..... 123/179 G, 179 L, 421, 123/424, 491, 339

[56] References Cited

U.S. PATENT DOCUMENTS

| | | | |
|---|---|---|---|
| 3,705,571 | 12/1972 | Horn et al. | 123/491 |
| 4,224,913 | 9/1980 | Barnard | 123/179 G X |
| 4,404,944 | 9/1983 | Yamazaki et al. | 123/179 L X |
| 4,416,234 | 11/1983 | Ikeura | 123/421 X |
| 4,434,760 | 3/1984 | Kobayashi et al. | 123/339 |

*Primary Examiner*—Tony M. Argenbright

*Attorney, Agent, or Firm*—Cushman, Darby & Cushman

[57] ABSTRACT

In a method of controlling the restart of an engine wherein the fuel amount is increased to prevent a restart failure of the engine from occurring at the time of the restart at high temperature, a fuel pressure is raised, a fuel amount is increased, an idling speed is raised and an idle ignition timing is advanced when the temperature of the engine is higher than a preset temperature and it is within a preset time period after the start of the engine, whereby the fuel consumption performance and the idling stabilizing performance are improved.

8 Claims, 5 Drawing Figures

METHOD OF AND SYSTEM FOR CONTROLLING RESTART OF ENGINE

BACKGROUND OF THE INVENTION

1. Field of the Invention

This invention relates to method of and system for controlling the restart of an engine, and more particularly to improvements in method of and system for controlling the restart of an engine, suitable for use in an engine for a motor vehicle provided with an electronic air-fuel ratio control device, wherein the fuel amount is increased during restart at high temperature to prevent a restart failure in the engine from occurring.

2. Description of the Prior Art

As one of the methods of feeding an air-fuel mixture of a predetermined air-fuel ratio to combustion chambers of an engine such as a motor vehicle engine, there is one using an electronic air-fuel ratio control device. This method is such that, in an exhaust system in an engine, there is provided an oxygen concentration sensor (hereinafter referred to as an "$O_2$ sensor") for sensing a rich or lean condition of air-fuel ratio from a residual oxygen concentration in an exhaust gas for example, whereby, for example, a valve opening period of injectors in an electronically controlled fuel injection device (i.e., fuel injection period), or a fuel flowrate or an air flowrate in an electronically controlled carburetor is controlled in accordance with an air-fuel ratio of the exhaust gas sensed by the $O_2$ sensor, so that an air-fuel mixture of a predetermined air-fuel ratio can be fed to engine combustion chambers, thereby enabling to secure the purification performance of a three-way catalyst provided downstream of the $O_2$ sensor for reducing HC, CO and $NO_X$, the harmful contents in the exhaust gas.

In this engine for a motor vehicle provided with the electronic air-fuel ratio control device, when the engine is stopped at high temperature and left as it is, fuel vapor is generated in a fuel line, whereby restart failure may occur. Hence, for example, such a countermeasure has been taken that the fuel injection period may be extended at high temperature in accordance with the temperature of engine cooling water at the time of restart of the engine (e.g., U.S. Pat. No. 3,705,571), or the fuel flowrate may be increased or the air flowrate is decreased, so that the fuel amount can be increased. However, heretofore, no control has been effected on the ignition timing. In consequence, the aspect of the ignition timing control has been rather neglected, and the fuel consumption performance has been sacrificed during idling for example.

SUMMARY OF THE INVENTION

The present invention has been developed to obviate the disadvantages of the prior art and has as its first object the provision of method of controlling the restart of an engine, capable of effecting the optimum control at the time of restart at high temperature, consequently, preventing a restart failure, and improving the fuel consumption performance and the idle stabilizing performance.

In addition to the above-described first object, the present invention has as its second object the provision of method of controlling the restart of an engine, capable of readily detecting the temperature of the engine.

In addition to the aforesaid first object, the present invention has as its third object the provision of method of controlling the restart of an engine, capable of accurately judging the temperature of the engine to be high.

In addition to the aforesaid first object, the present invention has as its fourth object the provision of method of controlling the restart of an engine, capable of easily increasing the pressure of fuel.

In addition to the aforesaid first object, the present invention has as its fifth object the provision of method of controlling the restart of an engine, capable of easily and reliably increasing the fuel amount.

In addition to the aforesaid first object, the present invention has as its sixth object the provision of method of controlling the restart of an engine, capable of reliably increasing an idling speed.

In addition to the aforesaid first object, the present invention has as its seventh object the provision of method of controlling the restart of an engine, capable of easily and reliably advancing an idle ignition timing.

The present invention has as its eighth object the provision of system for controlling the restart of an engine, capable of achieving the above-described respective objects.

To achieve the aforesaid first object, the present invention contemplates that the method of controlling the restart of an engine, wherein the fuel amount is increased at the time of the restart at high temperature to prevent a restart failure of the engine, from occurring as the gist thereof is shown in FIG. 1, includes:

a step of judging whether an engine temperature is higher than a preset temperature or not;

a step of judging whether it is within a preset period after the start of the engine or not when the engine is at such high temperature; and a step of increasing a fuel pressure, increasing the fuel amount, raising an idling speed and advancing an idle ignition timing when it is within the preset period after the start of the engine.

To achieve the aforesaid second object, the present invention contemplates that the engine temperature is detected through the temperature of an engine cooling water.

To achieve the aforesaid third object, the present invention contemplates that the preset temperature corresponds to a temperature at the lower limit of fuel vapor generation.

To achieve the aforesaid fourth object, the present invention contemplates that an intake pressure chamber of a fuel pressure regulator is opened to atmosphere to increase the aforesaid fuel pressure.

To achieve the aforesaid fifth object, the present invention contemplates that a pulse width of fuel injection is lengthened to increase the aforesaid fuel amount.

To achieve the aforesaid sixth object, the present invention contemplates that a flowrate of bypass air bypassing a throttle valve is increased to raise the aforesaid idling speed.

To achieve the aforesaid seventh object, the present invention contemplates that an ignition command signal fed to an ignition coil is quickend to advance the aforesaid idle ignition timing.

To achieve the aforesaid eighth object, the present invention contemplates that the system for controlling the restart of an engine includes:

an air flow sensor for detecting a flowrate of air taken in;

an idle switch for detecting the fully closed condition of a throttle valve;

an idle-up control valve for increasing a flowrate of bypass air bypassing the aforesaid throttle valve to raise an idling speed;

injectors for intermittently injecting pressurized fuel into the engine;

a fuel pressure regulator for controlling the pressure of fuel to a pressure higher by a preset pressure than an intake air pressure;

a fuel pressure control valve for opening an intake pressure chamber of the fuel pressure regulator to atmosphere to raise the fuel pressure;

spark plugs for igniting an air-fuel mixture introduced into combustion chambers of the respective cylinders of the engine;

crank angle sensors for emitting rotational angle signals in accordance with the rotation of the engine;

a water temperature sensor for sensing a temperature of engine cooling water; and an electronic control unit for calculating a basic injection period per cycle of the engine in accordance with the intake air flowrate and an engine speed obtained from the rotational angle signal, determining an executing injection period by correcting the result of calculation in accordance with at least the aforesaid temperature of engine cooling water and feeding a valve opening period signal to the injectors, and raising the fuel pressure, increasing the fuel amount, raising the idling speed and further advancing an idle ignition timing when the temperature of engine cooling water is higher than the preset temperature and it is within the preset time period after the start of the engine.

According to the present invention, within the preset period after the start of the engine at the time of the restart at high temperature, not only the fuel amount is increased but also the fuel pressure and the idling speed are raised, and moreover, the idle ignition timing is advanced, so that, at the time of the restart at high temperature, the fuel pressure, the air-fuel ratio, the idling speed and the idle ignition timing are controlled to the optimum values. In consequence, the restart failure can be reliably prevented from occurring, and the fuel consumption performance and the idling stabilizing performance can be improved throughout the engine operating conditions.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of one embodiment of the intake air flowrate sensing type electronically controlled fuel injection device in an engine for a motor vehicle, in which is adopted the method of controlling the restart of the engine according to the present invention, with reference to the drawings.

Figure 1:
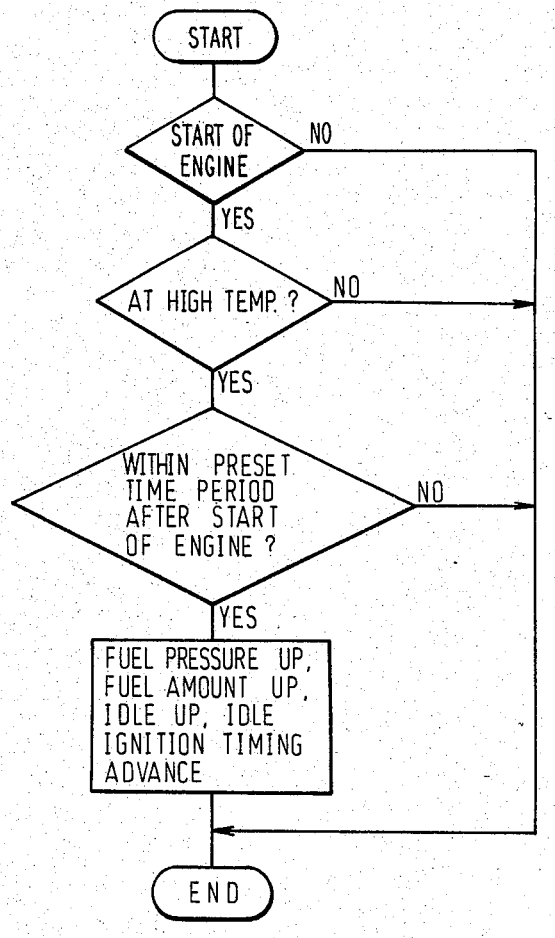
FIG. 1 is a flow chart showing the gist of the method of controlling the restart of an engine according to the present invention.
Figure 2:
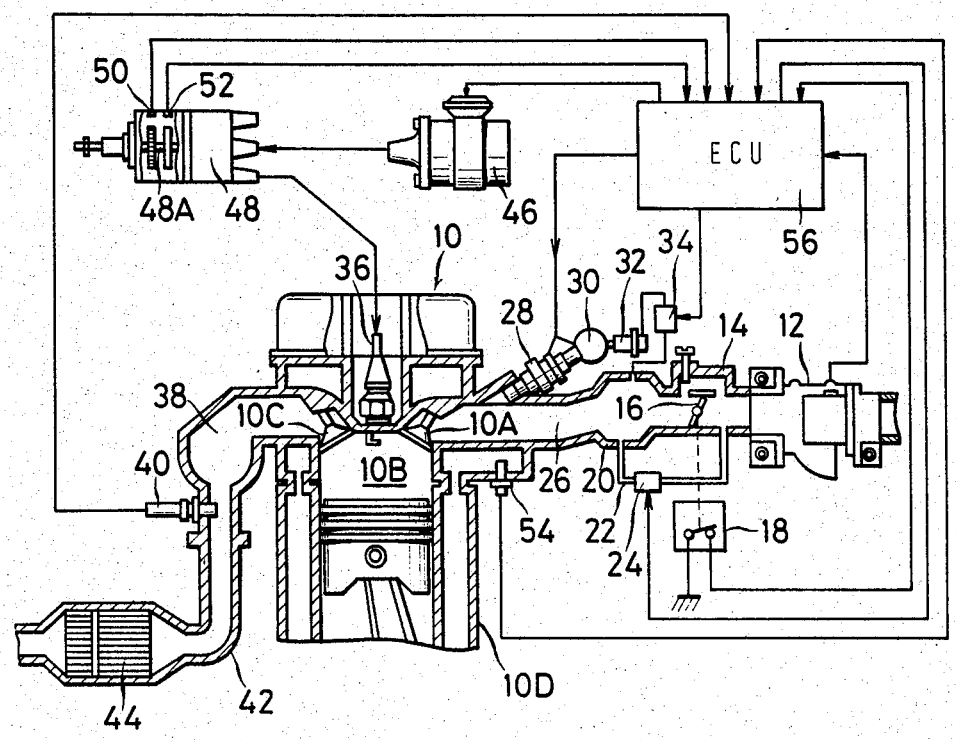
FIG. 2 is a sectional view partially including a block diagram, showing the arrangement of one embodiment of the intake air flowrate sensing type electronically controlled fuel injection device in an engine for a motor vehicle, to which the present invention is applied.

As shown in FIG. 2, this embodiment includes:

an air flow sensor 12 for detecting the flowrate of air taken in through an air cleaner, not shown;

a throttle valve 16 provided on a throttle body 14, adapted to be opened or closed in operational association with an accelerator pedal, not shown, provided in a driver's compartment, for controlling the flowrate of intake air;

an idle switch 18 adapted to be turned "ON" when the throttle valve 16 is fully closed, for detecting the fully closed condition of the throttle valve 16;

a surge tank 20 for preventing the interference of the intake air;

a bypass air pipeline 22 for bypassing the throttle valve 16 to communicate a portion upstream of the throttle valve 16 with the surge tank 20;

an idle-up control valve 24 for increasing the flowrate of bypass air flowing through the bypass air pipeline 22 to raise the idling speed;

injectors 28 provided on an intake manifold 26, for injecting pressurized fuel toward intake ports of respective cylinders of the engine 10;

a fuel delivery pipe 30 for distributing the pressurized fuel to the injectors 28 in the respective cylinders;

a fuel pressure regulator 32 for controlling the fuel pressure in the fuel delivery pipe 30 to a pressure higher by a preset pressure than an intake air pressure in accordance with the intake air pressure in the surge tank 20;

a fuel pressure control valve 34 for opening an intake air pressure chamber of the fuel pressure regulator 32 to atmosphere to raise the fuel pressure;

spark plugs 36 for igniting an air-fuel mixture introduced into combustion chambers 10B in the respective cylinders of the engine 10 through intake valves 10A;

an $O_2$ sensor 40 provided downstream of an exhaust manifold 38, for sensing a lean or rich condition between an exhaust air-fuel ratio and a target air-fuel ratio (e.g., a stoichiometric air-fuel ratio) from a residual oxygen concentration in the exhaust gas discharged through exhaust valves 10C;

a three-way catalytic converter 44 provided at the intermediate portion of an exhaust pipe 42;

a distributor 48 having a distributor shaft 48A rotatable in association with the rotation of a crankshaft of the engine 10, for distributing a secondary ignition signal of high voltage produced in an ignition coil 46 to the ignition plugs 36 of the respective cylinders of the engine 10;

crank angle sensors 50 and 52 incorporated in the distributor 48, for emitting rotational angle signals everytime the aforesaid crankshaft rotates through 30° and 360° for example, in accordance with the rotation of the distributor shaft 48A;

a water temperature sensor 54 provided on a cylinder block 10D of the engine 10, for sensing the temperature of engine cooling water;

an electronic control unit (hereinafter referred to as an "ECU") 56 for calculating a basic injection period per cycle of the engine in acordance with the intake air flowrate outputted from the air flow sensor 12 and an engine speed obtained from the rotational angle signal outputted from the crank angle sensor 50, determining an executing injection period by correcting the result of calculation in accordance with the temperature of engine cooling water outputted from the water temperature sensor 54, the lean or rich condition of the air-fuel ratio detected from an output of the $O_2$ sensor 40, and the like, outputting a valve opening period signal to the injectors 28, and controlling the idle-up control valve 24, the fuel pressure control valve 34 and the timing of generating the secondary ignition signal in the ignition coil 46, i.e., the ignition timing in accordance with the engine operating condition.

Figure 3:
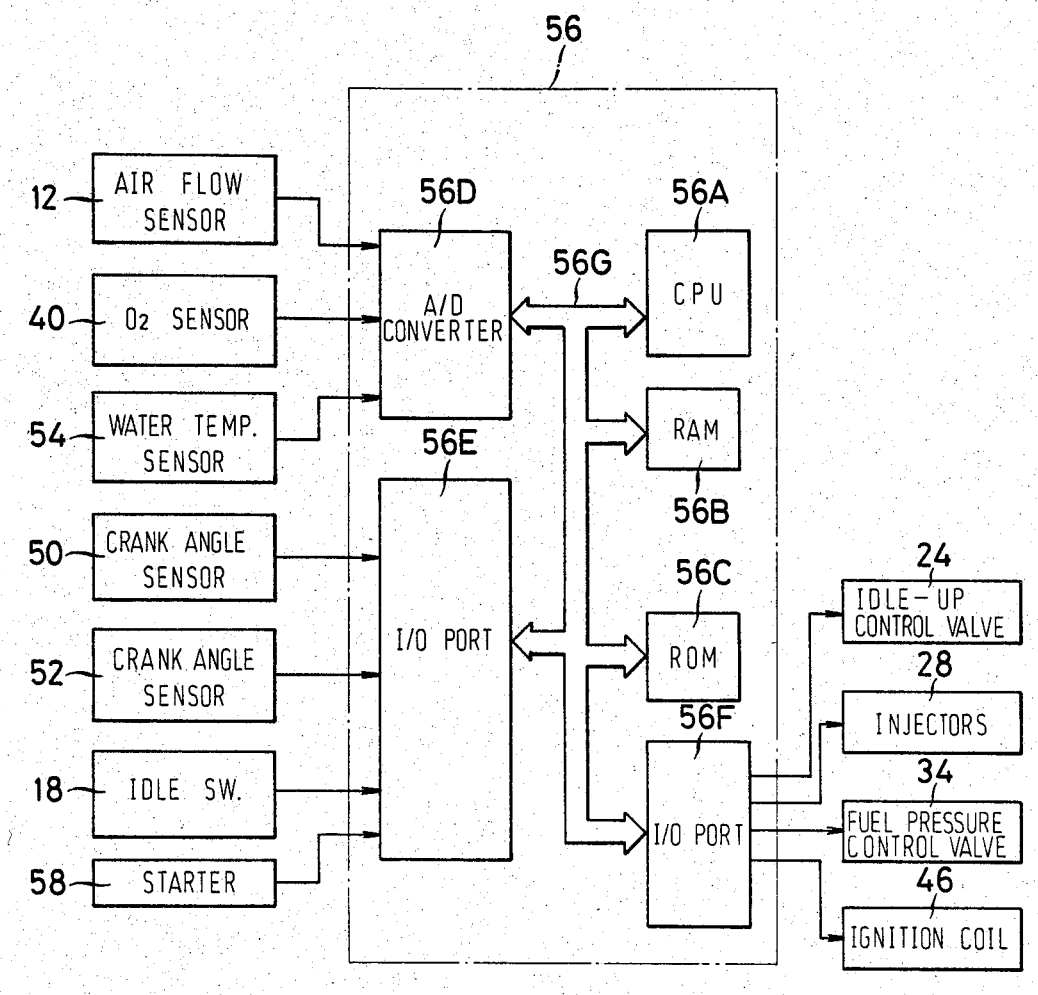
FIG. 3 is a block diagram showing the arrangement of the electronic control unit used in the above embodiment.

As detailedly shown in FIG. 3, the aforesaid ECU 56 includes:

a central processing unit (hereinafter referred to as a "CPU") 56A constituted by a microprocessor for example, for carrying out various operational processes;

a random access memory (hereinafter referred to as a "RAM") 56B for temporarily storing operational data in the CPU 56A and the like;

a read only memory (hereinafter referred to as a "ROM") 56C for storing control programs, various data and the like;

an analogue/digital converter (hereinafter referred to as an "A/D converter") 56D having an analogue multiplexer function for successively converting analogue signals inputted from the air flow sensor 12, the $O_2$ sensor 40, the water temperature sensor 54 and the like into digital signals and taking the same in;

an input/output port (hereinafter referred to an "I/O port") for taking in digital signals outputted from the crank angle sensors 50 and 52, the idle switch 18, a starter 58 and the like;

and I/O port 56F for outputting control signals to the idle-up control valve 24, the injectors 28, the fuel pressure control valve 34, the ignition coil 46 and the like in accordance with the results of operation in the CPU 56A; and a common bus 56G for connecting the aforesaid components to one another to carry out transferring data and commands, and so forth.

A well-known speed signal forming circuit is provided in the aforesaid I/O port 56E, whereby a digital signal representing a rotational speed of the engine 10 is formed from a pulse signal generated at each crank angle of 30° outputted from the crank angle sensor 50.

A pulse signal generated at each crank angle of 360° by the crank angle sensor 52 cooperates with the aforesaid pulse signal generated at each crank angle of 30° to be utilized for forming an interrupt requiring signal for calculating a pulse width of fuel injection, a fuel injection start signal, a cylinder discriminating signal and the like.

In the ROM 56C, there are previously stored a main process routine program, an interrupt process routine program for calculating a pulse width of fuel injection, interrupt process routine programs for calculating various correction coefficients, programs other than the above, and further, various data necessary for the processes of calculating the above, In the I/O port 56F, there is provided a well known fuel injection control circuit including a presettable down counter, a resistor and the like, wherein, from digital signals regarding a pulse width of fuel injection, which are inputted from the CPU 56A, injection pulse signals having such a pulse width as above are formed. These injection pulse signals are successively or simultaneously inputted to the injectors 34 through a drive circuit, not shown, and energize the injectors 34, whereby the amount of fuel commensurate to the pulse width of the injection pulse signals is injected.

As the ECU 56, ones having various arrangements differing from the above-described arrangement are usable. For example, such an arrangement may be adopted that no speed signal forming circuit is provided in the I/O port 56E, and a pulse signal generated through each predetermined crank angle is directly received by the CPU 56A, whereby a speed signal is formed by use of a software. Furthermore, such an arrangement may be used that no fuel injection control circuit is provided in the I/O port 56F, and a signal is formed which takes a logical value "1" only for a period corresponding to the pulse width of fuel injection.

Description will hereunder be given of action.

The CPU 56A takes in the latest data representing an engine speed N from the I/O port 56E in the course of its main process routine, and stores the same in the RAM 56B. Furthermore, due to an A/D conversion end interrupt from the A/D converter 56D, the CPU 56A takes in the latest data representing an intake air flowrate Q of the engine, the latest data having a value commensurate to an output voltage from the $O_2$ sensor 40, and the latest data representing an engine coolant temperature THW, and stores the same in the RAM 56B.

Figure 4:
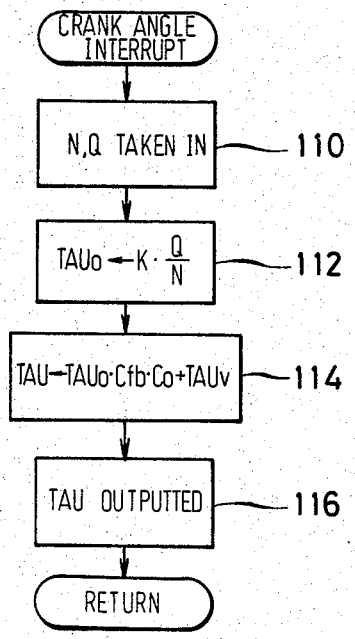
FIG. 4 is a flow chart showing the crank angle interrupt routine for calculating the pulse width of fuel injection used in the above embodiment.

Subsequently, the CPU 56A carries out a process routine shown in FIG. 4 in response to an interrupt requiring signal generated at a predetermined crank angle position so as to calculate a pulse width of fuel injection TAU. The process routine of the type described is well known. However, the content of this process routine will be explained briefly. More specifically, firstly, in Step 110, the CPU 56A takes in data on the intake air flowrate Q and on the engine speed N from the RAM 56B, and in Step 112, a basic injection pulse width $TAU_o$ is calculated through the following formula.

$$TAU_o \leftarrow K \cdot Q/N \quad (1)$$

where K is a constant.

Then, the process goes forward to Step 114, where the final executing injection pulse width TAU is calculated through the following formula by use of the basic injection pulse width $TAU_o$, a feedback correction coefficient Cfb, another correction coefficient $C_o$ determined in accordance with the engine coolant temperature THW, etc., and a value $TAU_v$ commensurate to an ineffective injection period of the injectors 28.

$$TAU \leftarrow TAU_o \cdot Cfb \cdot C_o + TAU_v \quad (2)$$

Subsequently, the process goes forward to Step 116, where data corresponding to the calculated executing injection pulse width TAU is set in the registor of the I/O port 56F, thus completing this routine.

Figure 5:
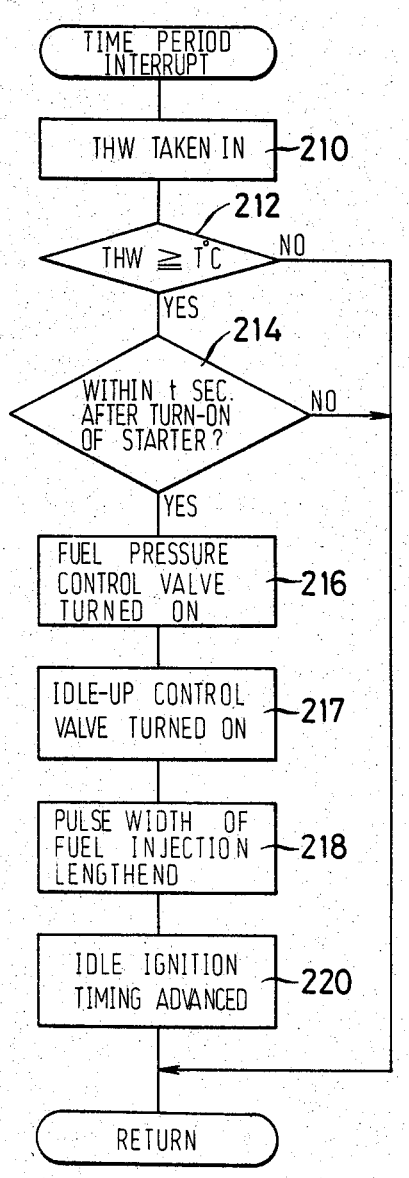
FIG. 5 is a flow chart showing the time period interrupt routine for carrying out the fuel pressure-up, the fuel amount increase, the idle-up and the idle angle advance according to the present invention used in the above embodiment.

The fuel pressure up, the fuel amount increase, idle up and the idle angle advance at the time of the restart at high temperature according to the present invention are carried out by an interrupt routine followed at each predetermined time as shown in FIG. 5. More specifically, firstly, in Step 210, the latest data representing the temperature of engine cooling water THW is taken in from the RAM 56B. Subsequently, the process goes forward to Step 212, where it is judged whether the temperature of engine cooling water THW is higher than a preset temperature T° C. corresponding to a temperature at the lower limit of fuel vapor generation. If the result of judgment is positive, then the process goes forward to Step 214, where it is judged whether it is within a preset period of t sec after a starter 58 is turned "ON", or not. If the result of judgment is positive, that is, it is judged to be within the period of the restart at high temperature, then the process goes forward to Step 216, where the aforesaid fuel pressure control valve 34 is turned "ON", whereby the intake air chamber of the fuel pressure regulator 32 is opened to atmosphere, the fuel pressure is raised and the pressure of the fuel vapor is relieved. Subsequently, the process goes forward to Step 217, where the idle-up control valve 24 is turned "ON", whereby the flowrate of the bypass air flowing through the bypass air pipe 22 is increased, so that an engine stall and the like are prevented from occurring, which would otherwise be caused by the decrease in the idling speed due to the decrease in the flowrate of the intake air as the result of the rise in temperature of the intake air at the time of high temperature. Subsequently, the process goes forward to Step 218, where additional coefficient $C_o$ used for calculation of the pulse width of fuel injection TAU is increased in value to lengthen the pulse width of fuel injection TAU, whereby the decrease in effective fuel amounts injected from the injectors 28 is compensated which would otherwise be caused by the injection of the fuel vapor generated in the fuel delivery pipe 30, so that the air-fuel ratio is prevented from becoming lean. Subsequently, the process goes forward to Step 220, where the ignition command signal outputted to the ignition coil 46 is quickened, so that the idle ignition timing can be advanced, thereby improving the fuel consumption performance during idling.

After the process in Step 220 or when the results of judgment in the aforesaid Steps 212 and 214 are negative, this routine is passed through.

In the above embodiment, all of the fuel pressure-up, the fuel increase, the idle-up and the advance of angle during idling at the time of the restart at high temperature are electronically controlled in accordance with the results of operation in the ECU 56, thus rendering the system simplified in construction. In addition, the arrangement of working the present invention need not necessarily be limited to this, but, for example, combination of the water temperature sensing valve with a timer makes it possible to effect control without using the ECU 56.

The above embodiment is the one in which the present invention is applied to the engine for a motor vehicle provided with the intake air flowrate sensing type electronically controlled fuel injection device, however, the scope of application of the present invention need not necessarily be limited to this, but, it is clear that the present invention can be also applied to an engine for a motor vehicle provided with an intake pipe pressure sensing type electronically controlled fuel injection device or ordinary engines provided with other types of air-fuel ratio control devices such as an electronically controlled carbureter.

It should be apparent to those skilled in the art that the above-bescribed embodiment is merely representative, which represents the application of the principles of the present invention. Numerous and varied other arrangements can be readily devised by those skilled in the art without departing from the spirit and the scope of the invention.

What is claimed is:

1. A method of controlling the restart of an engine to prevent a restart failure of the engine from occurring, comprising the steps of:

detecting start of said engine;

judging whether a temperature of said engine is higher than a preset temperature;

determining whether a preset period of time after said detected start of said engine has elapsed, if said engine temperature is judged higher than said preset temperature; and if said preset period of time has not elapsed, increasing fuel pressure to compensate for existing fuel vapor pressure, increasing the amount of injected fuel to compensate for an existing decrease in effective fuel amount, raising idling speed of said engine to prevent stalling of said engine and advancing idle ignition timing to improve fuel consunption performance.

2. A method as in claim 1, wherein said judged engine temperature is the temperature of cooling water of said engine.

3. A method as in claim 1, wherein said preset temperature corresonds to a temperature at a lower limit of fuel vapor generation in said engine.

4. A method as in claim 1, wherein said step of increasing fuel pressure includes a step of opening an intake pressure chamber of a fuel pressure regulator to atmosphere to thereby increase said fuel pressure.

5. A method as in claim 1, wherein' said step of increasing injected fuel includes the step of lengthening a pulse width of fuel injection to thereby increase said fuel amount.

6. A method as in claim 1, wherein said step of raising said idling speed includes the step of increasing a flowrate of bypass air bypassing a throttle valve to thereby raise said idling speed.

7. A method as in claim 1, wherein said step of advancing said idle ignition timing includes the step of controlling an ignition command signal fed to an ignition coil to thereby advance said idle ignition timing.

8. A system for controlling the restart of an engine, comprising:

means for detecting start of said engine;

air flow sensor means for detecting flowrate of air taken into said engine;

idle switch means for detecting a fully closed condition of a throttle valve of said engine;

idle-up control valve means for controllably increasing a flowrate of bypass air bypassing said throttle valve to thereby raise idling speed of speed engine;

fuel injectors for controllably injecting pressurized fuel into said engine;

fuel pressure regulator means for maintaining the pressure of said pressurized fuel at a pressure at least a preset amount higher than intake air pressure of said engine, as detected by said air flow sensor means;

fuel control valve means for controllably opening to atmosphere an intake pressure chamber of said fuel pressure regulator to thereby raise the pressure of said pressurized fuel;

spark plugs for controllably igniting air-fuel mixture introduced into combustion chambers of respective cylinders of said engine;

crank angle sensor means for emitting rotational angle signals in accordance with rotation of said engine;

water temperature sensor means for sensing the temperature of cooling water of said engine; and electronic control unit means for calculating a basic fuel injection period for said engine based on said detected intake air flowrate and rotational speed of said engine indicated by said rotational angle signals, for determining an executing fuel injection period by correcting said caculated basic fuel injection period in accordance with said sensed temperature of said engine cooling water and controlling said fuel injectors in accordance with said corrected fuel injection period, wherein said electronic control unit means includes means for determining that said sensed engine cooling temperature is above a predetermined temperature within a predetermined time period after said detected start of said engine, and in response to such determination, controlling said fuel control valve means to raise said fuel pressure to compensate for existing fuel vapor pressure, controlling said fuel injectors to increase the amount of injected fuel to compensate for effectively decreased fuel amounts, controlling said idle-up control valve means to raise said idling of said engine to thereby prevent stalling of said engine and controlling ignition of said spark pulgs to advance idle ignition timing to thereby improve engine fuel consumption performance.

* * * * *